US008648914B1

(12) United States Patent
Winker et al.

(10) Patent No.: US 8,648,914 B1
(45) Date of Patent: Feb. 11, 2014

(54) LASER COMMUNICATION SYSTEM FOR SPATIAL REFERENCING

(75) Inventors: Bruce K. Winker, Ventura, CA (US); Venkatarman Sundareswaran, Thousand Oaks, CA (US); Milind Mahajan, Thousand Oaks, CA (US); Steven L. Chen, Thousand Oaks, CA (US)

(73) Assignee: Teledyne Scientific & Imaging, LLC, Thousand Oaks, CA (US)

( * ) Notice: Subject to any disclaimer, the term of this patent is extended or adjusted under 35 U.S.C. 154(b) by 809 days.

(21) Appl. No.: 12/651,115

(22) Filed: Dec. 31, 2009

(51) Int. Cl.

| | |
|---|---|
| ***H04N 5/30*** | (2006.01) |
| ***F41G 7/00*** | (2006.01) |
| ***F42B 15/01*** | (2006.01) |
| ***G06F 19/00*** | (2011.01) |
| ***H04N 5/335*** | (2011.01) |

(52) U.S. Cl.
USPC ..... 348/162; 244/3.16

(58) Field of Classification Search
USPC ..... 348/162; 244/3.16
See application file for complete search history.

(56) References Cited

U.S. PATENT DOCUMENTS

| | | | | |
|---|---|---|---|---|
| 4,047,000 | A * | 9/1977 | Bryant et al. | 700/225 |
| 4,094,225 | A * | 6/1978 | Greenwood | 89/41.06 |
| 4,611,917 | A * | 9/1986 | Robieux et al. | 356/614 |
| 5,142,288 | A * | 8/1992 | Cleveland | 342/45 |
| 6,064,476 | A * | 5/2000 | Goltsos | 356/213 |
| 7,494,089 | B2 * | 2/2009 | Williams et al. | 244/3.16 |
| 7,768,444 | B1 * | 8/2010 | Rourk | 342/67 |
| 2003/0142406 | A1 * | 7/2003 | Robins et al. | 359/579 |
| 2003/0156293 | A1 * | 8/2003 | Kazuhiko et al. | 356/446 |
| 2004/0050240 | A1 * | 3/2004 | Greene et al. | 89/41.06 |
| 2005/0012660 | A1 * | 1/2005 | Nielsen et al. | 342/357.06 |
| 2007/0084927 | A1 * | 4/2007 | Itou et al. | 235/454 |
| 2008/0270338 | A1 * | 10/2008 | Adams | 706/48 |
| 2009/0001214 | A1 * | 1/2009 | Williams et al. | 244/3.15 |
| 2009/0078817 | A1 * | 3/2009 | Williams | 244/3.16 |

OTHER PUBLICATIONS

Leibowitz, Brian S.; A 256-Element CMOS Imaging Receiver for Free-Space Optical Communication; *IEEE Journal of Solid-State Circuits*; vol. 40, No. 9, Sep. 2005.

* cited by examiner

*Primary Examiner* — Chikaodili E Anyikire
(74) *Attorney, Agent, or Firm* — Snell & Wilmer LLP

(57) ABSTRACT

A laser communication and spatial referencing system and related methods provides effective and secure non-line-of-sight communications. A laser communication and spatial referencing system includes a laser transmitter transmitting a pulsed laser beam encoded with binary communications data, and an imaging data receiver for receiving the pulsed laser beam reflecting off a reflective target. The imaging receiver decodes the binary communications data and determines the position of the laser beam. The laser communication and spatial referencing system may operate synchronously and/or asynchronously, and may include a display displaying a video image of area surrounding the target with the reflecting location superimposed on the image to provide visual identification of the target.

51 Claims, 9 Drawing Sheets

LASER COMMUNICATION SYSTEM FOR SPATIAL REFERENCING

TECHNICAL FIELD

The present disclosure relates generally to electromagnetic communications, and in particular to laser-based targeting and/or communication systems with spatial referencing capabilities.

BACKGROUND

In modern warfare, ground forces in need of fire support or reinforcements often need to communicate accurate target coordinates and/or clear spatial references, for example to a remote surveillance or weapon platform. Conventional methods of generating and communicating spatial references needed to call for fire in open battlefields, such as target surveying, reading map coordinates, and laser target designation, are often not well-suited for use by small units on patrol in urban or other complex environments.

Ground troops engaged in an urban conflict are often disoriented, lack sophisticated equipment, or have unreliable radio frequency (RF) communication capability. A complicating factor in urban warfare is often the presence of infrastructure that can block transmissions, limit fields of view, and/or provide concealment and cover for enemy combatants. The infrastructure of a city typically includes tall buildings, narrow alleys, sewage tunnels, and possibly a subway or other transit system. The buildings can provide excellent sniping posts, while alleys and rubble-filled streets are well suited for planting booby traps. Additionally, defenders may have the advantage of detailed local knowledge of the area, layout of building interiors, and means of travel not shown on maps, allowing the defenders to move from one part of the city to another undetected. The attackers, however, must often move through open streets, particularly during a house to house search, which can expose the attacker on the streets.

Typically, when conducting operations in urban environments, ground forces calling for support need to clearly transmit verbal instructions over an RF communication system to identify prominent structures and other landmarks, and/or provide aim point corrections to improve the accuracy of remote ordnance. For close air support (CAS) operations, detailed target description information is usually transmitted verbally. Such conventional methods of spatial referencing, however, are frequently ambiguous, inaccurate, and frustratingly slow. Moreover, verbal communications from a dismounted soldier received at a remote platform are subject to miscommunication, for example due to noise from gunfire, garbled transmissions, and the like. In general, spatial coordinates of targets and locations of friendly forces potentially at risk from inaccurate firing should be positively confirmed before the remote weapon platform engages the enemy. Consequently, instructions are often repeated many times in an iterative procedure as the soldier and platform attempt to resolve ambiguities. Engagement of the enemy by a remote platform may thus take minutes or longer, and in many cases communication difficulties result in complete disengagement and an inability to provide the requested fire or other support. These communications delays compromise mission success and increase casualties. In certain instances, incorrect communication of target position has resulted in fratricide.

SUMMARY

The present disclosure is directed to spatial referencing. In an exemplary embodiment, a laser communication and spatial referencing system comprises a laser transmitter configured to transmit a laser beam, comprising: a first clock synchronized to an external timing device, and a laser beam modulator encoding binary data in the laser beam at a modulation rate synchronized to the first internal clock. The laser communication and spatial referencing system further comprises an imaging data receiver configured to decode the binary data, comprising: a second clock synchronized to the external timing device, and a sensor coupled to the second clock for detecting radiation from the laser beam reflecting off a reflective target.

In another exemplary embodiment, a laser transmitter configured to transmit a laser beam comprises an internal clock synchronized to an external timing device, a data reception unit configured to receive data from a user, and a laser beam modulator encoding the data in a laser beam at a modulation rate synchronized to the internal clock.

In another exemplary embodiment, an imaging data receiver comprises a clock synchronized to an external timing device, a filter synchronized to the clock, a sensor coupled to the clock, the sensor configured to detect a reflected laser beam synchronously with operation of the filter, and a data interpreter configured to decode binary data encoded in the laser beam.

In another exemplary embodiment, a laser communication and spatial referencing system comprises a laser transmitter configured to transmit a laser beam, comprising: a first clock operative at a first frequency, and a laser beam modulator encoding binary data in the laser beam at a modulation rate synchronized to the first internal clock. The laser communication and spatial referencing system further comprises an imaging data receiver configured to decode the binary data, comprising: a second clock operative at a second frequency, and a sensor coupled to the second clock for detecting radiation from the laser beam reflecting off a reflective target.

In another exemplary embodiment, a method comprises encoding, in a laser beam, a message comprising information associated with a target, and transmitting the encoded laser beam to a reflective surface. The reflective surface is visible to an imaging data receiver.

In another exemplary embodiment, a method comprises receiving, from a laser transmitter, a message comprising information associated with a target, wherein the message is encoded in a laser beam projected onto a reflective surface, and activating, responsive to the message, delivery of a weapon to the target.

In another exemplary embodiment, a method comprises receiving, from a laser transmitter, a message comprising information associated with a target, wherein the message is encoded in a laser beam projected onto a reflective surface, and overlaying, onto a direct view image of the target, the position of the laser beam on the reflective surface.

In another exemplary embodiment, a method comprises encoding, in a laser beam, a message comprising identify friend or foe (IFF) information, and transmitting the encoded laser beam through a diffuser, wherein the diffuser is visible to an imaging data receiver.

In another exemplary embodiment, an article of manufacture has stored thereon, computer-executable instructions that, if executed by an imaging data receiver, cause the imaging data receiver to perform operations comprising receiving, from a laser transmitter, a message comprising information associated with a target, wherein the message is encoded in a laser beam projected onto a reflective surface, and activating, responsive to the message, delivery of a weapon to the target.

In another exemplary embodiment, a communication and spatial referencing system comprises a transmitter configured to transmit radiation, comprising: a first clock operative at a first frequency, and a modulator encoding binary data in the transmitted radiation at a modulation rate synchronized to the first internal clock. The communication and spatial referencing system further comprises an imaging data receiver configured to decode the binary data, comprising: a second clock operative at a second frequency, and a sensor coupled to the second clock for detecting a portion of the transmitted radiation reflecting off a reflective target.

The contents of this summary section are provided only as a simplified introduction to the disclosure, and are not intended to be used to limit the scope of the appended claims.

BRIEF DESCRIPTION OF THE DRAWINGS

With reference to the following description, appended claims, and accompanying drawings, wherein like reference numerals designate like parts throughout the different views:

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for communications, signal processing, encryption, decryption, laser detection, laser modulation, and/or the like may not be described in detail herein. Furthermore, the connecting lines shown in various figures contained herein are intended to represent exemplary functional relationships, communicative relationships, and/or physical couplings between various elements. It should be noted that many alternative or additional functional relationships, communicative relationships, and/or physical connections may be present in a practical laser communication and spatial referencing system.

Figure 1A:
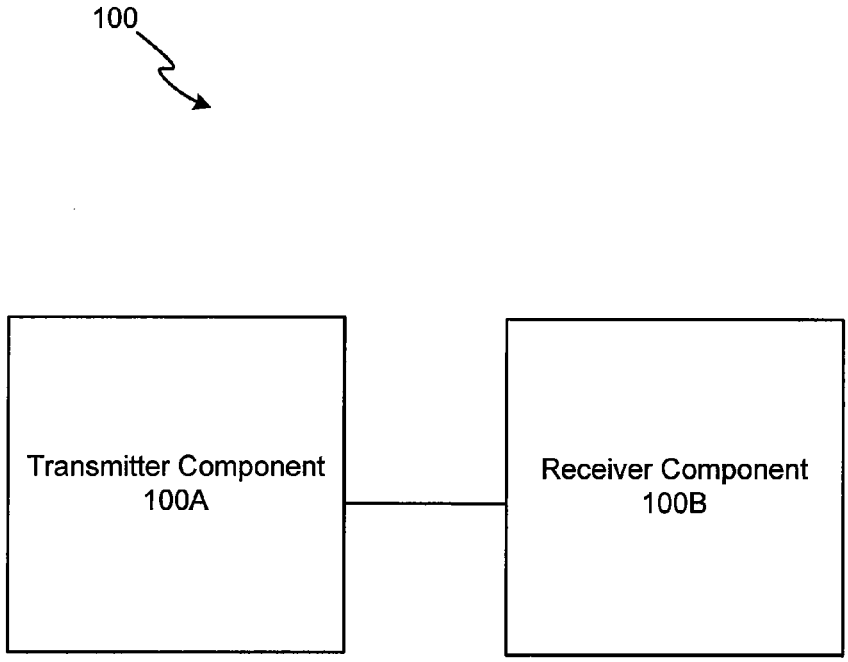
FIG. 1A illustrates a block diagram of a laser communication and spatial referencing system in accordance with an exemplary embodiment.

A laser communication and spatial referencing system may be any system configured to facilitate communication between a first party and a second party. In accordance with an exemplary embodiment, and with reference to FIG. 1A, a laser communication and spatial referencing system 100 generally comprises a transmitter component 100A, and a receiver component 100B in signal communication with, but located separately from, transmitter component 100A. Transmitter component 100A is configured to transmit a signal detectable by receiver component 100B. Receiver component 100B is configured to detect and process a signal from transmitter component 100A. Additionally, laser communication and spatial referencing system 100 may comprise multiple transmitter components 100A and/or multiple receiver components 100B, for example a transmitter component 100A and a receiver component 100B located on a rifle, a transmitter component 100A and a receiver component 100B located on an aerial weapon platform, and/or the like (i.e., laser communication and spatial referencing system 100 may be capable of one-way and/or two way communication).

In various exemplary embodiments, laser communication and spatial referencing system 100 is configured to provide ground based forces with a fast, reliable, and secure way for non-line-of-sight communication with other ground forces and/or remote weapon platforms to address the need for rapid spatial referencing. In these exemplary embodiments, laser communication and spatial referencing system 100 enables a remote weapon platform to be harnessed by a soldier at the terrestrial level, for example to allow the soldier to identify a target with a laser transmitter and thereby direct fire from the platform as though he was in control of the weapon himself. Additionally, laser communication and spatial referencing system 100 may also provide encoded voice and/or data communication. Additionally, laser communication and spatial referencing system 100 may be configured to support the ability to coordinate fire among dismounted soldiers. In various exemplary embodiments, laser communication and spatial referencing system 100 may automatically generate at least a portion of a CAS 9-line form to simplify and significantly reduce the time for preparation and transmission of the form. Moreover, laser communication and spatial referencing system 100 may provide a secure means of communication between a remote receiver and a dismounted soldier (such as a downed pilot), for example to facilitate rescue operations in the field.

Figure 1B:
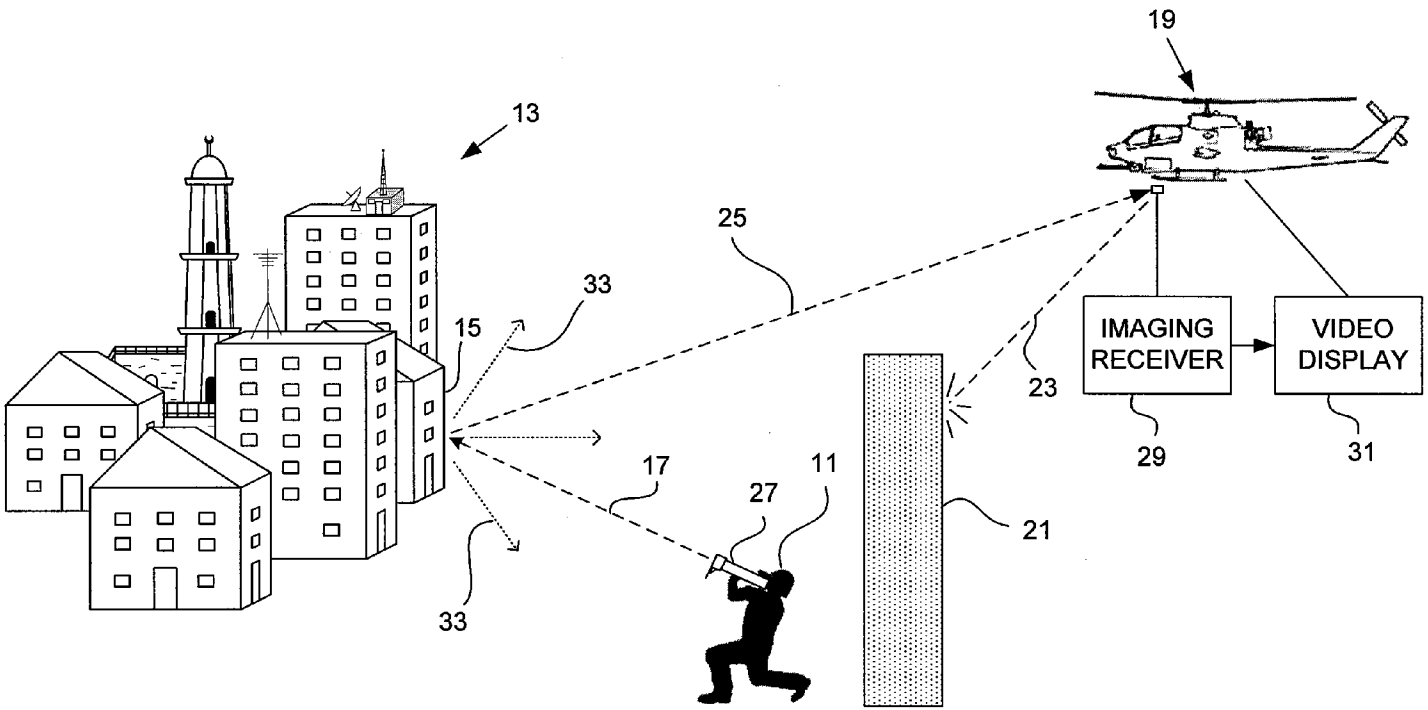
FIG. 1B illustrates a diagram of a laser communication and spatial referencing system, wherein an imaging data receiver receives a reflected transmission from a laser transmitter in accordance with an exemplary embodiment.

In accordance with various exemplary embodiments, and with reference now to FIG. 1B, a laser communication and spatial referencing system 100 comprises a transmitter component 100A (e.g., laser transmitter 27) and a receiver component 100B (e.g., imaging data receiver 29). Laser communication and spatial referencing system 100 further comprises video display 31. Laser transmitter 27 is configured to transmit an electromagnetic signal, e.g. a laser beam. Imaging data receiver 29 is configured to detect an electromagnetic signal reflecting off a target. Imaging data receiver 29 may be configured to detect various types of reflected electromagnetic signals (e.g., specular reflections, diffuse reflections, and/or combinations of the same). Video display 31 is configured to display the location of the reflected laser beam, and may also be configured to display video images of the area surrounding the target.

In various exemplary embodiments, laser communications and spatial referencing system 100 is configured to provide small units, such as platoons, squads and even individual dismounted soldiers, with a compact, low-cost laser communication means that can operate at long range during the day time, while still being eyesafe at a short distance from the transmitter. In addition, laser communication and spatial referencing system 100 enables ground forces to exchange data and/or establish a voice channel in RF-denied operations, for example by pointing their respective laser transmitters 27 and imaging data receivers 29 at the same spatial location (i.e., a target). In these exemplary embodiments, each unit may have a both a laser transmitter 27 and imaging data receiver 29 affixed to a rifle or other crew-served weapon, integrated together into a single handheld device, and/or integrated into a vehicle-mounted sensor or targeting system.

With continued reference to FIG. 1B, in accordance with an exemplary embodiment, a dismounted soldier 11 is engaging a hostile force in an urban combat environment 13. The soldier is able to visually identify the source of enemy fire as a target 15 along a direct line-of-sight 17 from the soldier to the target. The soldier desires to call for artillery or other ordnance from a remote weapon platform 19, for example artillery, an armored vehicle, a fighter jet, an attack helicopter, and/or other ground or airborne support. Depending on the location of the soldier, however, one or more obstructions 21 may interfere with and/or prevent conventional RF or other communication along a direct line-of-sight 23 between weapon platform 19 and the soldier. However, by utilizing laser communication and spatial referencing system 100, the soldier is able to communicate with weapon platform 19 along a reflected or non-line-of-sight (NLOS) communication path 17 and 25.

In various exemplary embodiments, upon detecting an electromagnetic signal from laser transmitter 27, imaging data receiver 29 is configured to spatially locate the target, display the target position on video display 31, and decode information encoded in the electromagnetic signal, such as information often provided in a CAS 9-line form. Imaging data receiver 29 may perform various detection and/or processing steps in a rapid manner, for example in one second or less. By utilizing a ground soldier to suitably identify the target location, the remote weapon platform 19 may immediately begin to approach and engage the target, for example without first having to resolve the target features well enough to identify it as a target from a platform located at a long stand-off range. The weapon platform 19 may thus be enabled to engage the target directly from a long stand-off range without undue delay. Additionally, because radio contact with the soldier is unnecessary, iterative communications may be eliminated, and target engagement time may be drastically reduced.

Figure 3:
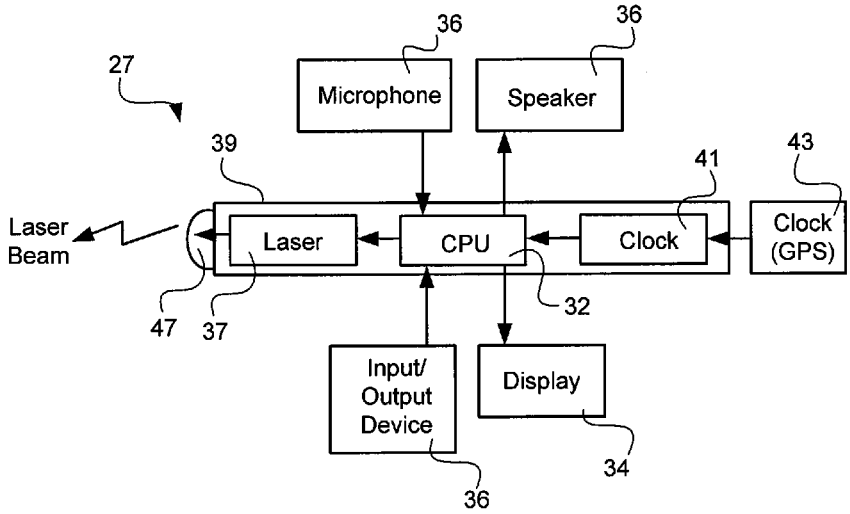
FIG. 3 illustrates a block diagram of a laser transmitter in accordance with an exemplary embodiment.

Laser transmitter 27 may comprise any suitable components, assemblies, electronics, and/or the like configured to transmit an electromagnetic signal, for example a coherent beam of electromagnetic radiation. In accordance with an exemplary embodiment, and with reference now to FIG. 3, laser transmitter 27 comprises laser component 37, central processing unit (CPU) 32, clock 41, and housing 39. Laser transmitter 27 may further comprise display 34, and/or one or more input/output devices 36 (for example, a speaker, an audio transducer, a keypad, a biometric sensor, and/or the like).

In accordance with an exemplary embodiment, CPU 32 comprises an integrated circuit configured to process information. For example, CPU 32 may be a floating point gate array (FPGA) or other specialized digital processing device configured to produce timing signals of sufficient precision to utilize when modulating a laser. CPU 32 may comprise a single component; alternatively, CPU 32 may comprise a plurality of integrated electronic components, discrete components, and/or other electronic information processing devices.

In an exemplary embodiment, laser component 37 is enclosed in housing 39. Laser component 37 may comprise any suitable signal generation components, for example an amplitude modulated laser diode. Moreover, laser component 37 may comprise a semiconductor laser, a solid-state laser, a vertical cavity surface emitting laser (VCSEL), a separate confinement heterostructure quantum well laser, a distributed feedback laser, a q-switched laser, a continuous wave laser, and/or any other suitable components configured to generate coherent electromagnetic radiation.

Laser component 37 may output coherent electromagnetic radiation at a suitable wavelength, for example about 850 nm. Laser component 37 may also output coherent electromagnetic radiation at other wavelengths, for example 808 nm, 1064 nm, 1550 nm, and/or the like. Moreover, laser component 37 may output at any suitable wavelength, as desired. Laser transmitter 27 may thus be operative in infrared wavelengths, visible wavelengths, ultraviolet wavelengths, or other suitable wavelengths.

Housing 39 may comprise any suitable materials, structures, components, and/or elements configured to provide structural support and/or alignment of laser transmitter 27. In an exemplary embodiment, housing 39 comprises aluminum. In other exemplary embodiments, housing 39 comprises reinforced plastic or other suitable durable material. In various exemplary embodiments, housing 39 is generally rectangular and/or cylindrical in shape. In certain exemplary embodiments, housing 39 has a length from about one inch to about ten inches. However, housing 39 may have any suitable length, width, and/or other dimensions, as desired.

Housing 39 may also include a diffuser 47 mounted to the transmitting end of laser transmitter 27. Diffuser 47 may comprise any suitable material configured to at least partially diffuse electromagnetic radiation generated by laser component 37. Diffuser 47 may be hinge-mounted, for example in order to be moved by hand into multiple positions. In an exemplary embodiment, diffuser 47 is configured to be moved into two positions: (i) a targeting position, in which diffuser 47 is moved away from the path of laser beam 17; and (ii) a beaconing position, in which diffuser 47 is moved at least partially into the path of laser beam 17. In the targeting position, uninhibited transmission of laser beam 17 toward a target is enabled. In the beaconing position, diffuser 47 at least partially disperses the laser beam, for example generally in all directions within about $2\pi$ steradians of the transmitting end of laser transmitter 27.

Figure 2:
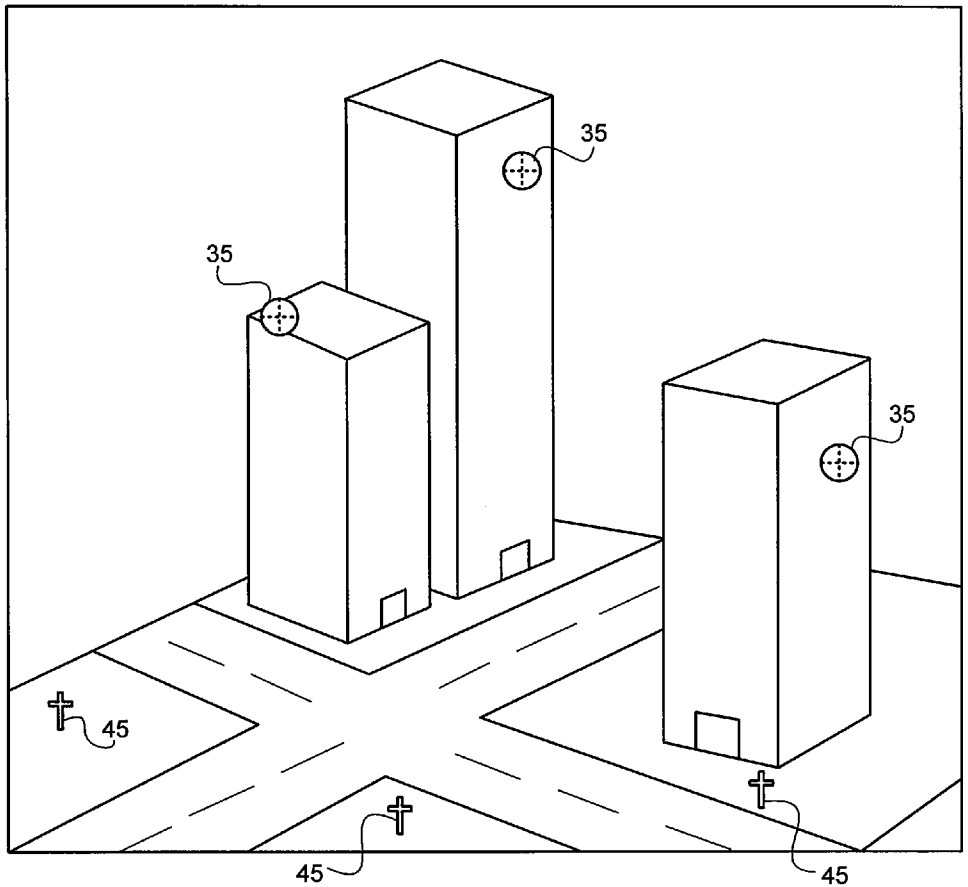
FIG. 2 illustrates a target scene having information overlaid theron in accordance with an exemplary embodiment.

In certain exemplary embodiments, the diffuser may be mechanically linked to a toggle switch (not shown) configured to change identify-friend-or-foe (IFF) data encoded on a laser transmission depending on the position of the toggle switch. For example, in the targeting position, the IFF data code may indicate "foe" so that a remote weapon platform receiving the laser transmission can positively identify a target reflecting the laser as an enemy position, for example position 35 illustrated in FIG. 2. In the beaconing position, the IFF data code may indicate "friend" so that a remote weapon platform receiving the transmission can positively identify the position of friendly ground forces, for example forces 45 illustrated in FIG. 2.

Laser transmitter 27 may further comprise one or more display components 34, for example indicator lights, liquid crystal displays, and/or other suitable data display devices. Display components 34 may be configured to display status information regarding laser communication and spatial referencing system 100, information received from imaging data receiver 29, and/or other suitable information, as desired.

Laser transmitter 27 may also comprise one or more data input/output devices 36. In an exemplary embodiment, data input/output device 36 comprises a keypad configured to allow a user to input communications intended for encoding as a bit sequence in the laser beam. In another exemplary embodiment, data input/output device 36 comprises an audio transducer configured to enter audio data, for example voice communications, and convert the audio into binary bits. In various exemplary embodiments, data input/output device 36 comprises a speaker. Data input/output device 36 may also comprise a touchscreen, a biometric sensor, and/or other suitable communication and/or authentication components, as desired.

By utilizing data input/output components 36, laser transmitter 27 may be capable of two-way communication with imaging data receiver 29. Laser transmitter 27 and imaging data receiver 29 may communicate at full-duplex or half-duplex, as desired.

Imaging data receiver 29 may acknowledge receipt of a laser transmission from laser transmitter 27 via any suitable method. For example, laser transmitter 27 may further comprise an optical data receiver co-boresighted with the laser beam. Remote platform 19 may possess a laser for illumination, designation, and/or rangefinding of targets. Remote platform 19 may point this laser at the spot illuminated by laser transmitter 27. Remote platform 19 may thus send a simple pulse sequence or other suitable message to acknowledge receipt of a transmission from laser transmitter 27. The optical data receiver on laser transmitter 27 may then receive this acknowledge signal from remote platform 19.

In certain exemplary embodiments, a user interface on laser transmitter 27 includes indicator lights or other suitable features configured to show the operating mode (i.e., targeting, IFF, and the like), status of a transmission (i.e., acknowledged or not), and/or status of the weapon to be delivered (i.e., target location programmed, weapon in flight, weapon time to impact, and the like). Moreover, a user interface on laser transmitter 27 may comprise any suitable indicators, lights, displays, and/or other communicative components, as desired.

In certain exemplary embodiments, laser communication and spatial referencing system 100 may operate in a synchronous manner. In these exemplary embodiments, enclosed within housing 39 is a clock module 41 that may be configured to acquire navigation and/or synchronous timing data from an external source 43, such as a global positioning system (GPS) satellite. Clock module 41 is coupled to laser component 37 to synchronize pulsed laser transmission. For example, laser component 37 may generate a collimated laser beam that may be modulated and/or otherwise encoded, for example at a low data rate to encode ASCII characters, numerical data, and/or the like. In an exemplary embodiment, the encoding technique utilizes synchronous detection at imaging data receiver 29 in order to reduce the laser power output of laser transmitter 27 suitable for a focal plane array (FPA) sensor, for example FPA 55, to detect a data bit.

In various exemplary embodiments, laser transmitter 27 comprises a hand-held device easily carried by a soldier. Laser transmitter 27 may emit a laser beam visible to the human eye. Laser transmitter 27 may also emit a laser beam having a wavelength outside the visible spectrum so that the beam is not visible to enemy forces. Laser transmitter 27 may utilize a wavelength stabilized laser. In various exemplary embodiments, laser transmitter 27 utilizes a wavelength stabilized laser configured with a wavelength drift with respect to temperature of less than 0.1 nanometer per degree Celsius (nm/° C.), with respect to a reference point inside housing 39. Moreover, laser transmitter 27 may comprise any suitable laser and/or other signal generation components, as desired.

In various exemplary embodiments, laser transmitter 27 is equipped with an aiming device, for example a scope or a sight, so that a soldier can direct the laser beam along a direct line of sight 17 to the intended target 15. In other exemplary embodiments, laser transmitter 27 is mounted on a weapon, for example a rifle, enabling a soldier to use the weapon sights to aim laser transmitter 27. Laser transmitter 27 may also include components configured to encode and transmit digital information within the laser beam, as discussed above. When the target is a reflective or diffuse reflector, for example earth, wood, stone, concrete, brick and most other structural building materials, the incident beam from laser transmitter 27 will generally reflect from target 15 in all directions 33 within about $2\pi$ steradians about the target.

Imaging data receiver 29 may comprise any suitable components, electronics, detectors, and/or the like configured to detect electromagnetic energy within a desired wavelength range, for example within the wavelength range transmitted by laser transmitter 27. In accordance with an exemplary embodiment, imaging data receiver 29 is mounted on weapon platform 19. Imaging data receiver 29 may also be located in any suitable location, for example in an airborne location with a wide field of view of a combat area, in a ground location with a view of the target area, and/or the like. Imaging data receiver 29 is configured to receive a reflected transmission from laser transmitter 27 and identify the spatial location of the point of reflection, for example target 15 illustrated in FIG. 1B.

Figure 4A:
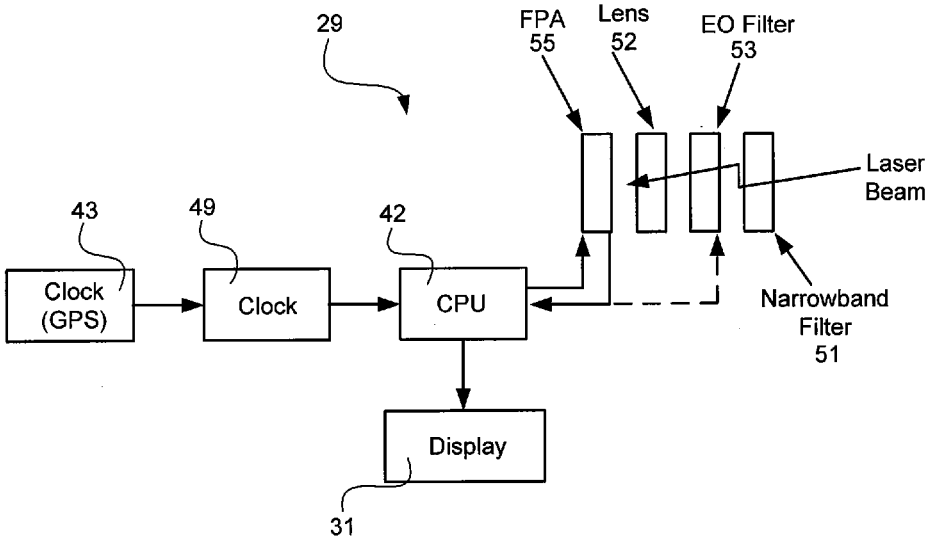
FIG. 4A illustrates a block diagram of an imaging data receiver in accordance with an exemplary embodiment.

With reference now to FIG. 4A, in an exemplary embodiment imaging data receiver 29 comprises an internal clock 49, a narrowband filter 51, and a sensor, for example focal plane array (FPA) 55. Imaging data receiver may also comprise a central processing unit (CPU) 42, an electro-optical (E-O) filter 53, a lens 52, and/or other suitable components.

CPU 42 may comprise any suitable information processing component or components configured to process information, for example information received from laser transmitter 27. In various exemplary embodiments, CPU 42 may comprise an FPGA, a digital signal processor (DSP), and/or other specialized digital processor configured to decode a transmitted signal and/or determine the location of the transmitted signal on FPA 55.

Internal clock 49 may comprise any components configured to provide suitable temporal accuracy and precision to enable operation of laser communication and spatial referencing system 100. For example, clock 49 may comprise a stabilized conventional clock, a chip-scale atomic clock, and/or the like. Clock 49 may also comprise a module capable of receiving external timing signals from a theater-wide reference clock. The theater-wide reference clock may be RF transmitted, for example from a global positioning system (GPS) satellite 43, in order to periodically synchronize one or more components of imaging data receiver 29.

Narrowband filter 51 may comprise any suitable components, electronics, filters, and/or the like configured to reduce and/or reject background radiation and/or otherwise improve the signal to noise ratio of a signal received from laser transmitter 27. In accordance with an exemplary embodiment, filter 51 is configured with bandwidth less than about 5 nm, and a field of view (FOV) greater than about 4 degrees.

In certain exemplary embodiments, the background signal from the ambient illuminated scene may be too weak to record using imaging data receiver 29 when using a 5 nm narrowband filter and a short signal integration time. In these exemplary embodiments, a separate camera (not shown) may be utilized to record an image of the target scene. The FOV of the second camera may be co-registered with the FOV of imaging data receiver 29. As used herein, "co-registered" may be understood to mean the imaging data receiver 29 field of view is coincident with and registered with the field of view of a display, camera direct view sight, and/or the like in such a manner that an object position in the imaging data receiver 29 field of view is displayed in the same position as the same object is displayed when viewed by the camera or direct view sight.

The FOV of imaging data receiver 29 may also be co-registered with the FOV of a direct view telescope. The telescope may contain a display that projects the location of a transmission from laser transmitter 27 (and/or encoded text and/or numerical data from the transmission) into the telescope FOV so that the displayed information is co-registered and overlaid with the direct view scene. The spatial resolution of imaging data receiver 29 required to identify the location of the laser spot is less than the resolution otherwise required to resolve the target features well enough to identify the target. Imaging data receiver 29 and/or associated display components may therefore have substantially lower spatial resolution than that of a direct view telescope, thereby reducing the size, weight and cost of an integrated weapon sight and imaging data receiver 29.

In certain exemplary embodiments, narrowband filter 51 may be switchable and/or removable, providing a transparent mode such that a single FPA 55 may be used to collect scene imagery and detect signals from laser transmitter 27. When filter 51 is active, two or more FPAs 55 may be utilized. Filter 51 may be placed in front of and/or behind E-O filter 53, and E-O filter 53 is located in front of FPA 55. As illustrated in FIG. 4A, in an exemplary embodiment lens 52 is located behind E-O filter 53 and narrowband filter 51. In other exemplary embodiments, lens 52 may be located at any suitable location in order to suitably focus incoming radiation for detection by FPA 55.

Moreover, in certain exemplary embodiments the FOV of imaging data receiver 29 may be calibrated with an inertial measurement system. In this manner, absolute target coordinates may be obtained for a detected location of a reflected signal from a laser transmitter 27.

In an exemplary embodiment, imaging data receiver 29 comprises E-O filter 53, for example components configured to operate as an electro-optical "shutter". One or both of narrowband filter 51 and E-O filter 53 may be provided to assist in rejecting ambient background radiation. In this exemplary embodiment, E-O filter 53 is configured to provide a "snapshot" having a duration of about 1 ms or less, allowing FPA 55 to capture an image by integrating all pixel rows at the same time. In other exemplary embodiments, E-O filter 53 is configured to provide a "snapshot" of any suitable duration, and the 1 ms duration illustrated previously is by way of illustration and not of limitation.

In an exemplary embodiment, FPA 55 comprises a conventional progressive scan FPA. FPA 55 may include an analog-to-digital converter (ADC) or analog comparator to convert photo-induced charge on an FPA pixel to a digital signal. In other exemplary embodiments, FPA 55 may comprise a scanning array, a "snapshot" integration FPA, and/or any other suitable sensor component or components. In various exemplary embodiments, FPA 55 is configured with a pixel format of 160×120 pixels or greater. FPA 55 is further configured with a pixel pitch of 100 microns or smaller. In an exemplary embodiment, FPA 55 is configured with a pixel format of 320×240 pixels or greater and a pixel pitch of no more than 50 microns. Moreover, FPA 55 may be configured with any suitable pixel format and/or pixel pitch, as desired. Imaging receiver 29 may also be equipped with a means for decoding digital information encoded on the laser beam for communications purposes, as will be discussed in further detail below.

Each optical receiver of FPA 55 may include various components, for example a charge-to-voltage converter, a low noise amplifier, a matched filter, a comparator, an ADC, and/or other components, for example in order to implement high signal-to-noise ratio detection, synchronization and/or decoding of laser transmissions.

In various exemplary embodiments, laser communication and spatial referencing system 100 operates in an asynchronous manner wherein no link to a system-wide master clock is utilized. In these exemplary embodiments, laser transmitter 27 and imaging data receiver 29 operate on separate clocks, which may have similar frequencies but are not necessarily synchronized to have the same phase.

In these exemplary embodiments, in should be appreciated that FPA 55 is not merely an array of individual data receivers. Rather, FPA 55 is configured to output data in the form of image frames (i.e., an array of X columns by Y rows of pixel signals), rather than signal streams from each individually selected pixel. The size of an image frame of FPA 55 may be any suitable size. In an exemplary embodiment, the size of an image frame of FPA 55 is 512 pixels or greater. This feature enables imaging data receiver 29 to not only detect and decode a laser transmission from laser transmitter 27, but also to locate and/or track the position of the laser spot on FPA 55. In addition, the pixels of FPA 55 may be configured with a small pitch (for example, less than 100 microns) and a large detector fill factor (for example, greater than 25%). Imaging data receiver 29 is therefore configured to process frames of data from FPA 55 in order to detect, locate and/or decode a laser transmission from laser transmitter 27.

Figure 5B:
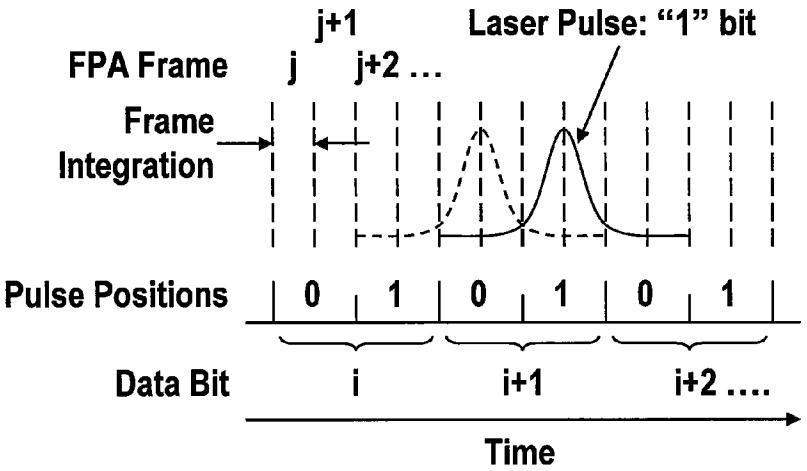
FIGS. 5A and 5B illustrate operational principles of an exemplary focal plane array in accordance with an exemplary embodiment.
Figure 5A:
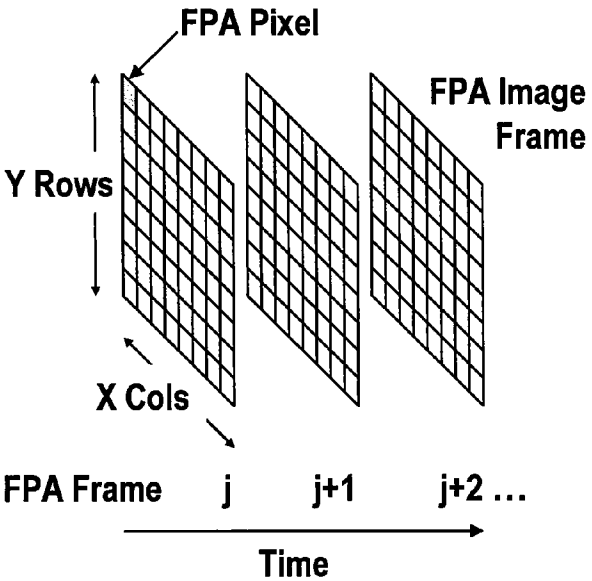

With reference now to FIGS. 5A and 5B, in certain exemplary embodiments, the frame integration period of each frame of FPA 55 may be equal to or less than the frame period, where the frame period is considered to have a value of 1 divided by the frame rate. Each sequential FPA frame of data may therefore comprise one nearly simultaneous integration period of an array of pixels. Subsequent FPA frames of data may be collected, for example to continuously monitor an array of pixel signals in parallel. The frame rate of FPA 55 may be at least equal to the bit transmission rate of laser transmitter 27. The frame rate of FPA 55 may also be higher than the bit transmission rate of laser transmitter 27, for example in order to enable imaging data receiver 29 to determine the beginning and end of individual laser pulses and thereby synchronize imaging data receiver 29 to laser transmitter 27. In an exemplary embodiment, the FPA 55 frame rate is at least twice the bit transmission rate of laser transmitter 27. In other exemplary embodiments, the FPA 55 frame rate is at least four times the bit transmission rate of laser transmitter 27.

Moreover, by operating in an asynchronous manner, laser communication and spatial referencing system 100 may be configured to support multiple laser transmitters 27, for example if each laser transmitter 27 is operated from a separate spatial "window" of imaging data receiver 29, each window having independent timing delays.

In various exemplary embodiments, imaging receiver 29 includes a data interpreter, for example CPU 42, for decoding binary data encoded on a transmission from laser transmitter 27. For example, CPU 42 may read the binary data as a series of bits and convert the bits to alphanumeric characters or text for display to the user. CPU 42 may also convert the binary data to an audio signal and/or any other suitable output, as desired.

Components of imaging data receiver 29 may be integrated within a single module. Imaging data receiver 29 may also be mounted on a weapon platform for enabling targeting and data communication between the platform and dismounted soldiers.

In an exemplary embodiment, a compact imaging data receiver 29 may be constructed for portable use by dismounted soldiers, for example at the platoon or squad level, to coordinate small arms fire and/or to facilitate data and IFF communications on the ground. In this exemplary embodiment, the compact imaging data receiver 29 may include similar components as those illustrated in FIG. 4A. Certain components may desirably be reduced in size, power consumption, and/or the like, in order to be suitable for transportation and use by an individual or on a ground vehicle.

Figure 4B:
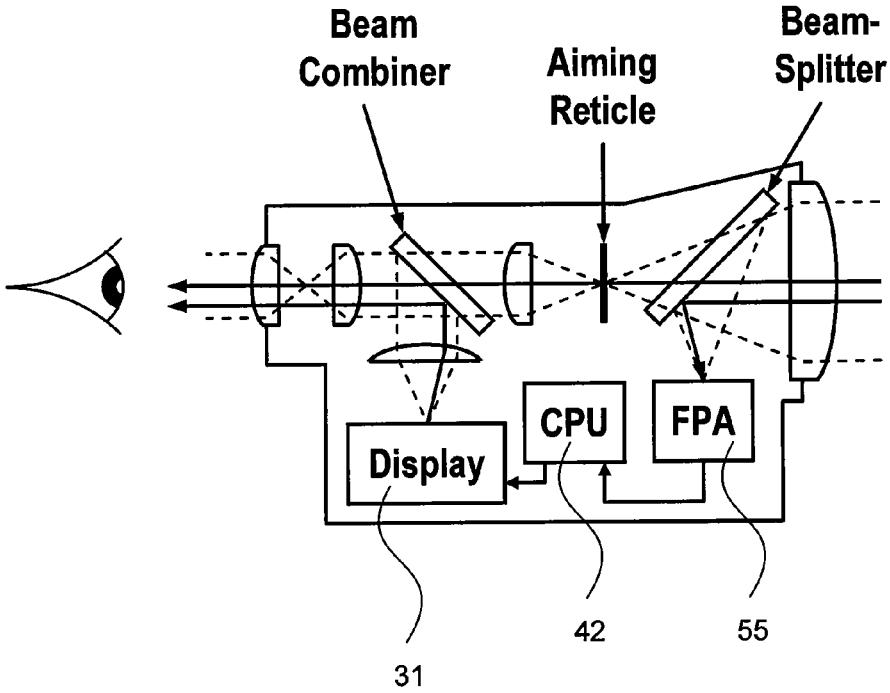
FIG. 4B illustrates a block diagram of an imaging data receiver co-boresighted with a direct view optical sight of a weapon in accordance with an exemplary embodiment.

Turning now to FIG. 4B, in accordance with various exemplary embodiments, imaging data receiver 29 may be integrated into a direct view sight, for example a telescopic, reflex, or holographic direct view sight. In a direct view sight the ambient light from the scene is transmitted through the sight to the viewer's eye. The sight comprises an aiming reticle that the soldier uses to point the weapon at the target, an imaging data receiver 29, and a digital graphic display. The field of view of the graphic display may be less than, equal to or greater than the field of view of imaging data receiver 29. Both fields of view are co-registered with the field of view of the direct view sight. Co-registering the fields of view of imaging data receiver 29, the graphic display, and the direct view may be done using a dichroic or polarizing beamsplitter and/or beam combiner, and/or via any suitable beam splitting and/or beam combining components as known in the art, for example a partially reflecting beamsplitter and/or beam combiner. The beamsplitter and/or beam combiner may be located at any suitable location in the optical path, as desired. The graphic display may be emissive or transmissive. When the graphic display is at least partially transparent, the graphic display may be located directly in the optical path of the direct view sight.

The imaging data receiver 29 field of view may be larger than, equal to, or smaller than that of the direct view sight. When a laser spot generated by laser transmitter 29 is within the field of view of imaging data receiver 29, imaging data receiver 29 may detect, locate, and/or decode the laser transmission. The graphic display creates one or more graphic symbols over the direct view sight field of view (which is also overlaid with the laser spot position).

Imaging data receiver 29 and graphic display continue to overlay the symbol on the laser spot location, even as the laser spot moves and/or the weapon aimpoint moves, as long as the laser spot is within field of view of imaging data receiver 29. Additionally, alphanumeric text or other data, for example data decoded from a laser transmission from laser transmitter 27, may be displayed in the aiming sight field of view.

In this manner, by utilizing a direct view sight having a digital graphic overlay for displaying laser communication and spatial referencing data, the resolution requirements for imaging data receiver 29 and/or display 31 are reduced, particularly when compared to digitizing the weapon sight field of view using a camera and displaying the scene using a graphic display. Accordingly, the overall size, weight and cost of imaging data receiver 29 and/or laser communication and spatial referencing system 100 may be thereby greatly reduced.

In various exemplary embodiments, with reference now to FIGS. 1B and 4A, imaging data receiver 29 is coupled to video display 31. Video display 31 may comprise any suitable components configured to display, process, and/or otherwise present information, for example video, still images, audio, and/or the like.

Video display 31 may be mounted on weapon platform 19 to provide a video image of a desired area, for example the area surrounding target 15. By co-registering the field of view of imaging data receiver 29 with the field of view of video display 31, one or more target locations detected by imaging data receiver 29 may be superimposed on a video image. In this manner, visual spatial reference of a target may be provided to a desired individual or individuals, for example a gunner or other weapon platform operator, a pilot, and/or the like. With momentary reference to FIG. 2, laser spots 35, each reflected from a different laser transmitter 27, are detected by imaging data receiver 29 and superimposed on the display to spatially locate one or more targets for the gunner. Moreover, data suitable for display on video display 31 may also be transmitted by laser communication and spatial referencing system 100 for display at a remote location, for example a command post, a forward area, or other desired location.

In accordance with various exemplary embodiments, laser communication and spatial referencing system 100 may be utilized as follows:

Text data, numerical data, and/or other suitable data may be encoded on the laser beam transmitted from laser transmitter 27, for example using a form of on/off keying (OOK), pulse code modulation (PCM), pulse position modulation (PPM), and/or other suitable encoding scheme. Laser transmitter 27 and imaging data receiver 29 may use a synchronous or asynchronous detection scheme that enables the detection of laser pulses (i.e. data bits) at very low laser power levels, for example at transmission power levels of less than 1 watt average power. Moreover, laser communication and spatial referencing system 100 may be functional at laser power levels of 50 mW average power or lower. Imaging data receiver 29 detects a laser spot generated by laser transmitter 27 and displays the spot position, for example on a video image of a battlefield scene, overlaid on a direct view image of a battlefield scene, and/or the like. Information encoded on the laser pulses may be displayed as well, for example as text, symbols, and/or the like.

In various exemplary embodiments, a laser spot projected by laser transmitter 27 is buried in background daylight illumination, and is visible only to an imaging data receiver 29 equipped with a narrowband filter 51 and using a compatible detection method (for example, synchronous detection, asynchronous detection, and/or the like). The detection method may be made secure via one or more suitable encryption schemes, as is known in the art. For example, laser communication and spatial referencing system 100 may utilize an encryption key agreed on in advance for use during battlefield operations during a particular time period.

The combination of narrowband filter and synchronous or asynchronous detection enable a compact, low power laser to quickly and covertly designate spatial locations and communicate short strings of information associated with those locations. The information can identify targets, provide target coordinates, or even call for fire or further surveillance of those targets. Moreover, in an exemplary embodiment, FPA 55 comprises a large number of sensing channels, for example greater than 256 sensing channels, allowing imaging data receiver 29 to distinguish among multiple transmissions from one or more laser transmitters 27 simultaneously.

In various exemplary embodiments, laser communication and spatial referencing system 100 may be utilized to identify non-targets. For example, laser communication and spatial referencing system 100 may be used to: identify friendly or non-combatant positions; coordinate reconnaissance, surveillance, and target acquisition (RSTA) efforts between sensor platforms; provide a beacon for reinforcements or for search and rescue efforts, and/or the like. Additionally, laser communication and spatial referencing system 100 may be configured to allow weapon platforms to identify targets even if the target, when viewed from the weapon platform, is smaller than a single pixel. This sub-resolution target identification capability enables a much wider sensor FOV, dramatically improving the effectiveness of a weapon platform at longer range, and also generally improves situational awareness. It also enables the use of low cost, low spatial resolution FPAs and/or image display devices to facilitate, for example, weapon-mounted or hand-held imaging data receivers wherein a laser spot location is displayed as a digital overlay on a direct view sight field of view.

In certain exemplary embodiments, laser communication and spatial referencing system 100 utilizes synchronous detection. In these embodiments, clocks 41 and 49, located respectively on laser transmitter 27 and imaging data receiver 29, are synchronized to a master clock 43, for example a clock signal provided by a GPS satellite. A frame rate of imaging data receiver 29 is therefore synchronized to a pulse repetition rate of laser transmitter 27. Imaging data receiver 29 may also include E-O filter 53 that is synchronized so that it opens to receive a laser transmission over a time period during which a laser pulse is emitted from laser transmitter 27. The pulse width of E-O filter 53 is configured to be long enough to allow for a variable time-of-flight between laser transmitter 27 and imaging data receiver 29. In an exemplary embodiment, the pulse width is greater than about 50 microseconds. In another exemplary embodiment, the pulse width is greater than about 10 microseconds. Moreover, the pulse width may be any suitable length of time, as desired.

During each frame of imaging data receiver 29, in an exemplary embodiment the laser pulse experiences a variable delay, for example a delay according to an OOK, PCM, PPM, or other suitable modulation scheme. Additional encoding schemes, for example Manchester codes, may also be advantageously used. The presence of a laser pulse during an integration window and/or camera frame produces a binary one data bit, whereas the absence of a laser pulse during a frame produces a binary zero data bit. Similarly, laser communication and spatial referencing system 100 may also be configured to interpret the absence of a laser pulse as a binary one data bit, and the presence of a laser pulse as a binary zero data bit. Moreover, use of a narrowband filter makes imaging data receiver 29 inherently jam-resistant.

In certain exemplary embodiments, both laser transmitter 27 and imaging data receiver 29 include an input device configured to enable the user of each device to enter a short code permitting the user to operate the respective device. The code may be updated as desired, for example on a daily basis. In an exemplary embodiment, laser transmitter 27 includes a time-out device (not shown) configured to prevent unauthorized persons from designating targets using laser transmitter 27.

Using these and other security features of laser communication and spatial referencing system 100, many forms of battlefield communications are facilitated. In an exemplary embodiment, a synchronous laser communication and spatial referencing system 100 may use a conventional image sensor to achieve a data rate of up to about 10,000 bits per second. Accordingly, laser communication and spatial referencing system 100 may communicate numerical data, short ASCII strings, and/or similar data in only a few seconds or less. For example, numerical values could include target location coordinates, identify the sender, refer to a library of longer messages stored in a lookup table, indicate emergency SOS status of a particular unit, and/or the like. ASCII strings could provide a textual description of the target, and include a call for fire. Moreover, a simple pulsed optical beacon, based on a synchronous detection method, may transmit IFF data. Multiple enemy and friendly locations may be illuminated, for example by separate laser transmitters 27. The receiving platform, for example imaging data receiver 29, may then simultaneously detect and distinguish between locations of enemy and friendly forces, for example via unique signatures of the received signals.

In an exemplary embodiment, laser communication and spatial referencing system 100 utilizes synchronous detection. In this exemplary embodiment, the use of synchronous detection and narrowband filtering can enable secure communication of laser pulses out to a range of about 10 km, target to receiver. Moreover, longer ranges may be achieved via use of stronger lasers and/or more sensitive detectors.

Various signal to noise ratio (SNR) calculations are illustrated in Table 1 for an exemplary airborne laser communication and spatial referencing system 100 having imaging data receiver 29 mounted on a stabilized gimbal. Laser transmitter 27 produces pulses of about 1 millijoule at 850 nm wavelength and at a repetition rate of between about 30 Hz and about 1,000 Hz. This corresponds to an average power consumption of up to about 1 watt, which is consistent with class III laser pointers/illuminators currently in use by U.S. military forces.

TABLE 1

| Range (km) | 1 | 3 | 10 | 30 |
|---|---|---|---|---|
| Laser signal | 2.73 × 10E5 | 3.04 × 10E4 | 2.73 × 10E3 | 304 |
| Solar bckgnd (bypass) | 4.08 × 10E3 | 4.08 × 10E3 | 4.08 × 10E3 | 4.08 × 10E3 |
| Solar bckgnd (blocking) | 1.14 × 10E3 | 1.14 × 10E3 | 1.14 × 10E3 | 1.14 × 10E3 |
| Dark noise | 6 | 6 | 6 | 6 |
| Read noise | 25 | 25 | 25 | 25 |
| Photon noise (laser) | 522 | 174 | 52 | 17 |
| Photon noise (bckgnd) | 72 | 72 | 72 | 72 |
| Signal-to-bckgnd ratio | 52 | 5.8 | 0.52 | .058 |
| SNR | 437 | 110 | 17.6 | 2.5 |
| Solar Bckgnd (no filter) | 3.4 × 10E7 | 3.4 × 10E7 | 3.4 × 10E7 | 3.4 × 10E7 |
| Photon noise (no filter) | 3.8 × 10E3 | 3.8 × 10E3 | 3.8 × 10E3 | 3.8 × 10E3 |

The SNR calculations of Table 1 assume that exemplary imaging data receiver 29 uses a 60 Hz frame rate, 640×480 CCD with a 2 inch aperture, 4°×3° FOV (1 m IFOV @ 10 km range) and 25 read noise electrons. In addition, imaging data receiver 29 is assumed to have a 0.5 ms shutter width. For a laser pulse width of 0.5 ms, the peak power of laser transmitter 27 is about 2 W. These results further assume full daylight illumination, Lambertian scattering, and 40% total scattering efficiency. In addition, the E-O filter is assumed to have a 5 nm spectral bandwidth, 90% peak transmission, and 30 dB blocking for all out-of-band wavelengths. These results also assume that the entire signal from laser transmitter 27 falls on one pixel of imaging data receiver 29. Moreover, at distances greater than about 1 km, the laser spot may be smaller than the pixel IFOV. In the worst case, the signal from laser transmitter 27 may fall on four pixels of imaging data receiver 29, and corresponding signal-to-background ratio and SNR values in Table 1 should be divided by four.

With continued reference to Table 1, according to an exemplary embodiment, various aspects of laser communication and spatial referencing system 100 are illustrated. First, a signal from laser transmitter 27 may be stronger than the solar background for certain ranges, for example ranges below 10 km. At a certain range, for example at about 10 km, the signal-to-background ratio falls below 1, but the SNR is still nearly 10. Second, over certain ranges, for example ranges between about 1 km and about 10 km, a signal from laser transmitter 27 may be between 100 to 10,000 times smaller than the solar background collected by a conventional imaging data receiver configured without a narrowband filter. Advantageously, a signal from laser transmitter 27 is therefore often not detectable over the background using a conventional sensor.

In various exemplary embodiments, laser communication and spatial referencing system 100 utilizes asynchronous detection. In these exemplary embodiments, the use of asynchronous detection and narrowband filtering can enable secure communication of laser pulses out to a range of about 10 km, target to receiver. Longer ranges may be achieved via use of higher power lasers and/or more sensitive detectors.

Moreover, in an exemplary embodiment, and with reference again to FIGS. 1B and 4A, a high frame rate FPA sensor may enable imaging data receiver 29 to operate at frame rates up to about 10,000 bits per second. In this exemplary embodiment, and in other exemplary asynchronous embodiments, access to a system-wide master clock is not necessary. Laser transmitter 27 and imaging data receiver 29 operate at nominally the same modulation and demodulation frequency. FPA 55 of imaging data receiver 29 operates at a suitable frame rate, for example a frame rate substantially higher than the data transmission rate. FPA 55 divides the laser pulse integration period into sequential shorter pulse integration periods and locates the beginning and end of the laser pulse. FPA 55 thus effectively adjusts an internal timing delay to lock onto the transmitter frequency. In this manner, imaging data receiver 29 is configured to support multiple asynchronous laser transmitters 27 if each laser transmitter 27 is operated from a separate spatial region (i.e., "window") of imaging data receiver 29. Each sensor of FPA 55 may include various components, e.g., charge-to-voltage converter, low noise amplifier, matched filter, thresholding amplifier, and/or the like, as needed to implement high signal-to-noise ratio detection, synchronization, and/or decoding of independent laser transmissions. Moreover, in various exemplary embodiments, use of a suitable FPA sensor and/or other suitable components can enable frame rates approaching 100,000 Hz or more.

Various signal to noise ratio (SNR) calculations are illustrated in Table 2 for an exemplary asynchronous laser communication and spatial referencing system 100, for example a ground-ground communication system between dismounted soldiers equipped with a handheld laser transmitter 27 and an imaging data receiver 29. In this exemplary embodiment, laser transmitter 27 produces laser pulses of about 1 microjoule to about 25 microjoules at 808 nm wavelength, and at a repetition rate of up to about 3000 Hz. In this exemplary embodiment, laser transmitter 27 utilizes a lower laser power level than the exemplary embodiment illustrated in Table 1. In this exemplary embodiment, laser beam generated by laser transmitter 27 is eyesafe at ranges beyond about 30 meters, and a maximum range is about 1,000 meters.

TABLE 2

| Range (m) | 100 | 200 | 500 | 1000 |
|---|---|---|---|---|
| Laser signal | 4.81 × 10E3 | 1.20 × 10E3 | 1.92 × 10E2 | 4.810 × 10E1 |
| Solar bckgnd (bypass) | 1.06 × 10E2 | 1.06 × 10E2 | 1.06 × 10E2 | 1.06 × 10E2 |
| Solar bckgnd (blocking) | 6.82 × 10E1 | 6.82 × 10E1 | 6.82 × 10E1 | 6.82 × 10E1 |
| Dark noise | <1 | <1 | <1 | <1 |
| Read noise | 15 | 15 | 15 | 15 |
| Photon noise (laser) | 69 | 35 | 14 | 7 |
| Photon noise (bckgnd) | 13 | 13 | 13 | 13 |
| Signal to bckgnd ratio | 27.5 | 6.9 | 1.1 | 0.28 |
| SNR | 62.6 | 25.2 | 5.4 | 1.4 |
| Solar bckgnd (no filter) | 6.84 × 10E4 | 6.84 × 10E4 | 6.84 × 10E4 | 6.84 × 10E4 |
| Photon noise (no filter) | 2.72 × 10E2 | 2.65 × 10E2 | 2.64 × 10E2 | 2.63 × 10E2 |

The SNR calculations of Table 2 assume that exemplary imaging data receiver 29 uses a 60 Hz frame rate, 640×480 CCD with a 2 inch aperture, 9°×6.5° FOV (0.25 m IFOV @ 1 km range) and 15 read noise electrons. In addition, imaging data receiver 29 is assumed to have a 10 microsecond shutter width. For a laser pulse width of 7.5 microseconds, the peak power of laser transmitter 27 would be only about 167 mW and the average power only about 3.8 mW. These results further assume full daylight illumination, Lambertian scattering, and 10% total scattering efficiency. In addition, narrowband filter 51 is assumed to have a 3 nm spectral bandwidth, 50% peak transmission, and 30 dB blocking for all out-of-band wavelengths. These results also assume that the entire signal is spread evenly over four pixels of imaging data receiver 29.

In various exemplary embodiments, laser communication and spatial referencing system 100 may utilize synchronized waveform generators. With reference now to FIG. 5, in accordance with an exemplary embodiment, an experimental setup 60 for synchronizing waveform generators is illustrated. Two waveform generators 61 and 63 are synchronized to an external source, clock 65, supplying a clock signal. First waveform generator 61 is configured to generate a bit pattern—either 1,0,1,0 or 0,0,1,1—which is used to modulate a laser source 67. Second waveform generator 63 is configured to supply a trigger to a camera 69 with a programmable delay. Laser source 67 is directed at a diffuse screen 71, and camera 69 is aligned to receive a laser signal reflected off screen 71. Point-Grey FlyCapture SDK software is used for handling a Point-Grey Firefly MV camera serving as camera 69. This camera has 640×480×8 bits grayscale, and 60 Hz using internal clocking or up to 58 Hz clocking using an external trigger. Capture, peak detection/location, display, and overlay of a target reticle at 60 Hz are accomplished using a Pentium-4 3.8 GHz or Pentium-4 Xeon 3.2 GHz personal computer.

The ability of a VGA-resolution machine vision camera to spatially and temporally detect and locate a pulsed laser spot in the FOV is demonstrated. The laser spot is resolved as either ON (a binary one bit) or OFF (a binary zero bit), synchronized with external clock 65. The camera is externally triggered using a clock signal derived from the same external clock 65, to ensure frequency and phase alignment of the laser source 67 and camera 69.

Figure 6:
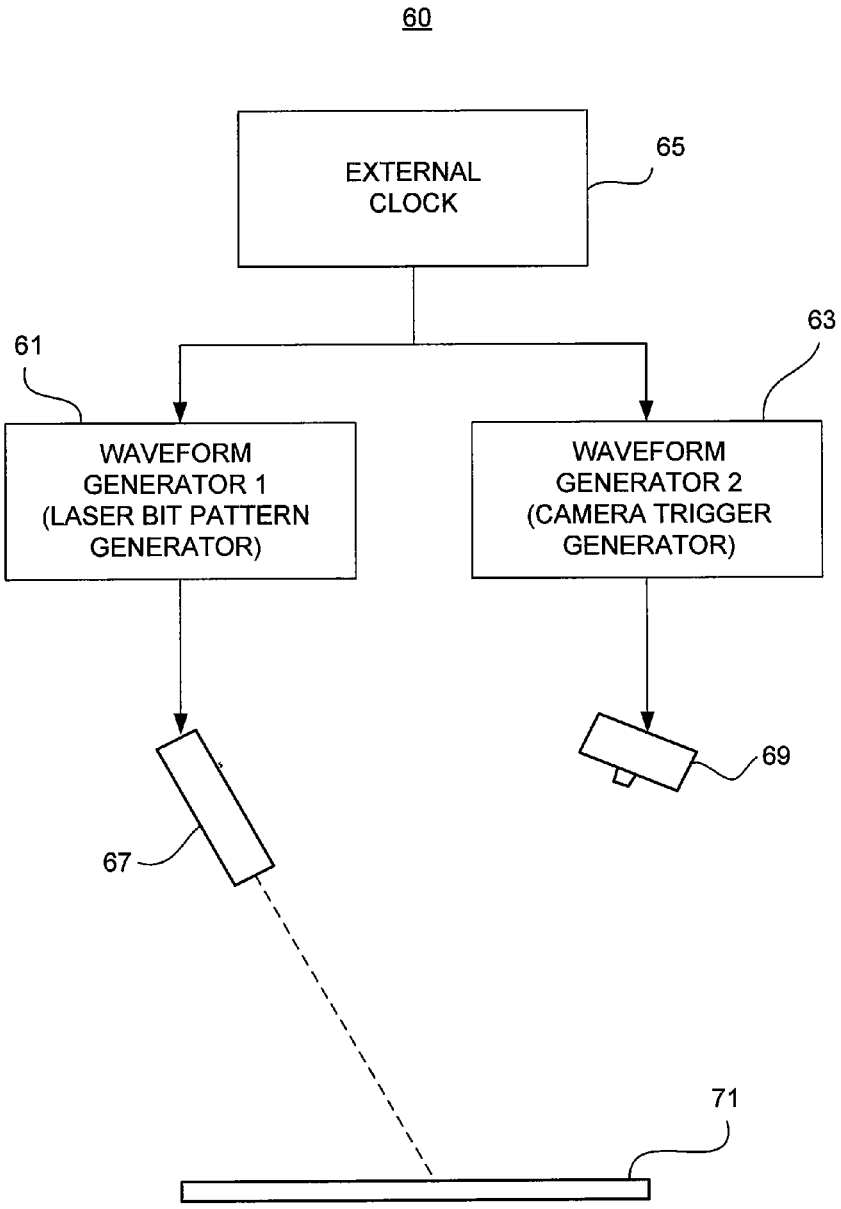
FIG. 6 illustrates a block diagram for synchronizing waveform generators in a laser communication and spatial referencing system in accordance with an exemplary embodiment.

With reference now to FIG. 6, certain exemplary experimental results are presented as a series of visual displays. Display 70 is an oscilloscope image showing the laser modulation 91 (bit pattern 1, 0, 1, 0) and the synchronized external trigger 92 with programmable delay for the camera. Arrows 93 indicate the falling edge of the trigger pulse. Displays 71 through 78 show eight consecutive camera frames, each having 0.47 ms exposure time and 58 Hz external trigger. The software processes these frames to retrieve the presence and spatial location of the laser spot (the white dot appearing in displays 72, 74, 76 and 78) as well as the modulation pattern 1,0,1,0 shown in consecutive displays.

Figure 7:
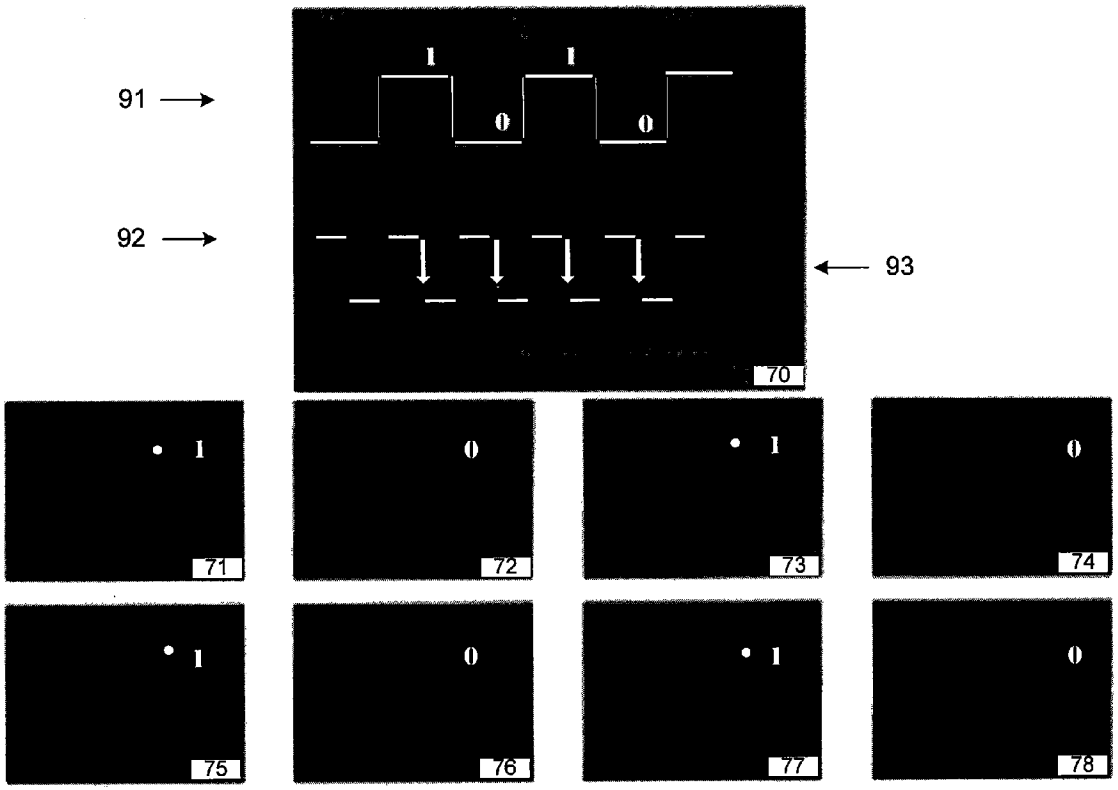
FIG. 7 illustrates oscilloscope displays of a first bit pattern modulating a laser transmission, a synchronized external trigger, and eight consecutive camera frames synchronized to the trigger in accordance with an exemplary embodiment.
Figure 8:
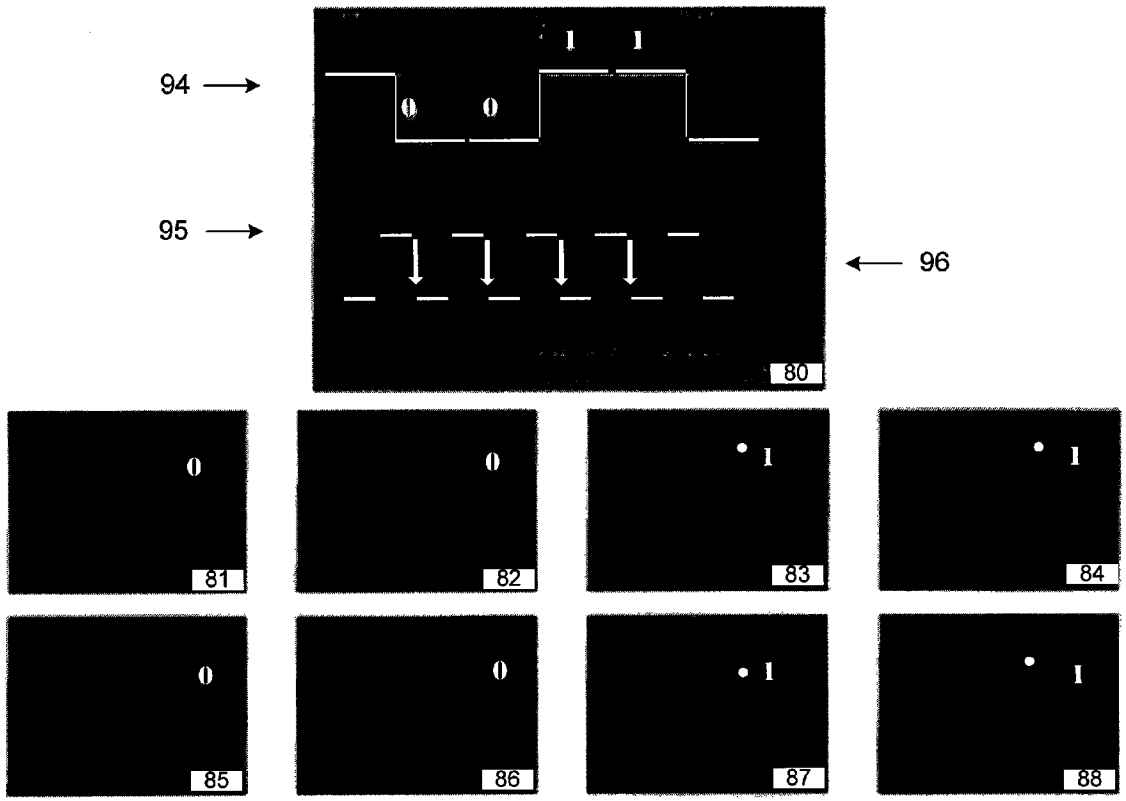
FIG. 8 illustrates oscilloscope displays of a second bit pattern modulating a laser transmission, a synchronized external trigger, and eight consecutive camera frames synchronized to the trigger in accordance with an exemplary embodiment.

FIG. 7 illustrates additional exemplary experimental results as a series of visual displays. Display 80 is an oscilloscope image showing the laser modulation 94 (bit pattern 0,0,1,1) and the synchronized external trigger 95 with programmable delay for the camera. Arrows 96 indicate the falling edge of the trigger pulse. Displays 81 through 88 show eight consecutive camera frames, each having 0.47 ms exposure time and 58 Hz external trigger. The software processes these frames to retrieve the presence and spatial location of the laser spot (the white dot appearing in displays 81, 82, 85 and 86) as well as the modulation pattern 1,1,0,0 shown in consecutive displays.

The foregoing exemplary experiment illustrates continuous laser spot detection, tracking, location readout, and display at up to 60 Hz.

Various principles of the present disclosure have been discussed hereinabove with respect to coherent radiation. It should be noted that various exemplary systems, components, and/or methods may also suitably be configured to utilize incoherent radiation.

As will be appreciated by one of ordinary skill in the art, principles of the present disclosure may be reflected in a computer program product on a tangible computer-readable storage medium having computer-readable program code means embodied in the storage medium. Any suitable computer-readable storage medium may be utilized, including magnetic storage devices (hard disks, floppy disks, and the like), optical storage devices (CD-ROMs, DVDs, Blu-Ray discs, and the like), flash memory, and/or the like. These computer program instructions may be loaded onto a general purpose computer, special purpose computer, or other programmable data processing apparatus to produce a machine, such that the instructions that execute on the computer or other programmable data processing apparatus create means for implementing the functions specified in the flowchart block or blocks. These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions specified in the flowchart block or blocks.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure and may be expressed in the following claims.

In the foregoing specification, various embodiments have been described. However, one of ordinary skill in the art appreciates that various modifications and changes can be made without departing from the scope of the present disclosure as set forth in the claims below. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, an optical connection, a communicative connection, a functional connection, and/or any other connection. When language similar to "at least one of A, B, or C" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A laser communication and spatial referencing system, comprising:

a laser transmitter configured to transmit binary data at a bit transmission rate, comprising:

a first internal clock synchronized to an external timing device; and a laser beam modulator for encoding the binary data in a laser beam at a modulation rate synchronized to the first internal clock wherein the laser transmitter is configured to transmit the laser beam corresponding to a plurality of pulses at a pulse transmission rate; and an imaging data receiver having a sensor for detecting radiation from the laser beam reflecting off a reflective target, wherein the imaging data receiver is configured to decode the binary data over a plurality of integration periods or image frames, and the imaging data receiver is configured with a frame rate that is a non-zero integer multiple of the pulse transmission rate or of the bit transmission rate.

2. The system of claim 1, wherein the imaging data receiver determines a target location by detecting radiation from the laser beam reflecting off the reflective target.

3. The system of claim 2, further comprising a video display configured to display an image of the reflective target corresponding to the detected target location.

4. The system of claim 1, wherein the external timing device comprises a GPS satellite.

5. The system of claim 1, wherein the imaging data receiver further comprises a second internal clock synchronized to the external timing device, and the sensor is synchronized to the second internal clock.

6. The system of claim 1, wherein the imaging data receiver is configured to derive the binary data responsive to the sensor detecting the laser beam.

7. The system of claim 6, wherein the laser beam modulator encodes the binary data using Manchester encoding for increasing a signal-to-noise ratio corresponding to the plurality of pulses.

8. The system of claim 1, wherein the imaging data receiver further comprises a filter configured to reject radiation having a wavelength at least 2.5 nm different from the wavelength of the laser beam.

9. The system of claim 1, wherein the imaging data receiver further comprises a shutter synchronized to the modulation rate.

10. A laser communication and spatial referencing system, comprising:

a laser transmitter configured to transmit binary data at a bit transmission rate, comprising:

an internal clock synchronized to an external timing device;

a data reception unit configured to receive data corresponding to a sound, a video, a user-inputted message or combinations thereof; and a laser beam modulator for encoding the data in a laser beam at a modulation rate synchronized to the internal clock wherein the laser transmitter is configured to transmit the laser beam corresponding to a plurality of pulses at a pulse transmission rate; and an imaging data receiver having a sensor for detecting radiation from the laser beam reflecting off a reflective target, wherein the imaging data receiver is configured to decode the binary data over a plurality of integration periods or image frames for analyzing the sound, the video, the user-inputted message or the combinations thereof and wherein the imaging data receiver is configured to decode the binary data over a plurality of integration periods or image frames, and the imaging data receiver is configured with a frame rate that is a non-zero integer multiple of the pulse transmission rate or of the bit transmission rate.

11. The system of claim 10, wherein the external timing device comprises at least one of a GPS satellite, a terrestrial RF transmitter, or an airborne RF transmitter.

12. The system of claim 10, wherein the data reception unit comprises at least one of a keypad, an audio transducer, a biometric sensor, or a touchscreen.

13. The system of claim 10, wherein the data reception unit translates the data into a binary signal.

14. The system of claim 12, wherein the laser transmitter is further configured to transmit audio data received from an audio transducer according to a half duplex transmission protocol.

15. The system of claim 14, wherein the audio transducer translates the audio data into a binary signal.

16. The system of claim 10, wherein the laser beam has an average power of less than one watt.

17. The system of claim 10, wherein the imaging data receiver is configured with a frame rate that is a non-zero integer multiple of the pulse transmission rate or of the bit transmission rate.

18. The system of claim 10, wherein the laser beam wavelength is temperature stabilized to vary less than 0.1 nanometer per degree Celsius of temperature variation within the laser transmitter.

19. A communication and spatial referencing system, comprising:

a laser transmitter configured to transmit binary data at a bit transmission rate, comprising:

a clock synchronized to an external timing device;

a filter synchronized to the clock; and a laser beam modulator for encoding the binary data in a laser beam at a modulation rate synchronized to the clock, wherein the laser transmitter is configured to transmit the laser beam corresponding to a plurality of pulses at a pulse transmission rate; and an imaging data receiver comprising:

a sensor coupled to the clock, the sensor configured to detect a reflected laser beam synchronously with operation of the filter; and a data interpreter configured to decode the binary data encoded in the laser beam over a plurality of integration periods or image frames, and the data interpreter is configured with a frame rate that is a non-zero integer multiple of the pulse transmission rate or of the bit transmission rate.

20. The system of claim 19, wherein the sensor comprises detector elements less than 100 microns in pitch.

21. The system of claim 19, wherein the sensor comprises detector elements less than 50 microns in pitch.

22. The system of claim 19, wherein the sensor has a pixel format of 160 by 120 pixels or larger.

23. The system of claim 19, wherein the sensor has a pixel format of 320 by 240 pixels or larger.

24. The system of claim 19, further comprising a video screen configured to display the location of the laser beam co-registered with an image of a target reflecting the laser beam.

25. The system of claim 19, wherein the data interpreter generates a binary one if the sensor detects the laser beam during a predetermined time interval, and otherwise generates a binary zero.

26. The system of claim 19, further comprising a narrow-band filter rejecting background radiation.

27. The system of claim 19, wherein the sensor is configured with more than 256 sensing channels.

28. The system of claim 27, wherein the imaging data receiver is configured to detect and process multiple reflected laser beams simultaneously.

29. The system of claim 19, wherein the sensor is configured with a pixel fill factor greater than 25%.

30. The system of claim 19, wherein the frame rate is at least twice the bit transmission rate.

31. The system of claim 19, wherein the imaging data receiver is configured to track the position of the reflected laser beam.

32. The system of claim 19, further comprising a display component configured to overlay data obtained from the laser beam over a direct view image of a target.

33. A laser communication and spatial referencing system, comprising:

a laser transmitter configured to transmit binary data at a bit transmission rate, comprising:

a first internal clock operative at a first frequency; and a laser beam modulator for encoding the binary data in a laser beam at a modulation rate synchronized to the first internal clock wherein the laser transmitter is configured to transmit the laser beam corresponding to a plurality of pulses at a pulse transmission rate; and an imaging data receiver, comprising:

a second internal clock operative at a second frequency, and a sensor coupled to the second internal clock for detecting radiation from the laser beam reflecting off a reflective target, wherein the imaging data receiver is configured to decode the binary data over a plurality of integration periods or image frames, and the imaging data receiver is configured with a frame rate that is a non-zero integer multiple of the pulse transmission rate or of the bit transmission rate.

34. The laser communication and spatial referencing system of claim 33, wherein the first frequency and the second frequency have different values.

35. A laser communication and spatial referencing system, comprising:

a laser transmitter configured to transmit a laser beam, comprising:

a first clock operative at a first frequency; and a laser beam modulator for encoding binary data in the laser beam at a modulation rate synchronized to the first clock; and an imaging data receiver configured to decode the binary data, comprising:

a second clock operative at a second frequency, wherein the first frequency and the second frequency have different values; and a sensor coupled to the second clock for detecting radiation from the laser beam reflecting off a reflective target, wherein the sensor divides a laser pulse integration period into sequential shorter pulse integration periods to locate the beginning and end of a pulse of the laser beam.

36. The laser communication and spatial referencing system of claim 33, wherein the imaging data receiver is configured with a frame rate at least twice the bit rate of the laser transmitter.

37. The laser communication and spatial referencing system of claim 33, wherein the imaging data receiver is configured with a frame rate at least four times the bit rate of the laser transmitter.

38. The laser communication and spatial referencing system of claim 33, wherein the imaging data receiver is configured to track the position of the radiation from the laser beam reflecting off the reflective target.

39. A method, comprising:

providing a laser transmitter configured to transmit binary data at a bit transmission rate;

providing a first clock synchronized to an external timing device;

encoding, using a laser beam modulator and in a laser beam, the binary data corresponding to a message comprising information associated with a target at a modulation rate synchronized to the first clock;

transmitting, using the laser transmitter, the laser beam corresponding to a plurality of pulses at a pulse transmission rate;

detecting, using a sensor, the laser beam reflecting off a reflective surface, wherein the reflective surface is visible to an imaging data receiver; and decoding, using the imaging data receiver, the binary data over a plurality of integration periods or image frames, wherein the imaging data receiver is configured with a frame rate that is a non-zero integer multiple of the pulse transmission rate or of the bit transmission rate.

40. The method of claim 39, further comprising receiving, from the imaging data receiver, confirmation the message was received at the imaging data receiver.

41. The method of claim 39, wherein the message comprises fire control information.

42. A method, comprising:

providing a laser transmitter configured to transmit binary data at a bit transmission rate;

providing a first internal clock synchronized to an external timing device;

encoding, using a laser transmitter, the binary data corresponding to a message comprising information associated with a target in a laser beam at a modulation rate synchronized to the first internal clock;

transmitting, using the laser transmitter, the laser beam corresponding to a plurality of pulses at a pulse transmission rate, the laser beam being projected onto a reflective surface;

detecting, using a sensor, the laser beam reflecting off the reflective surface;

decoding, using the imaging data receiver, the binary data over a plurality of integration periods or image frames, wherein the imaging data receiver is configured with a frame rate that is a non-zero integer multiple of the pulse transmission rate or of the bit transmission rate; and activating, responsive to the message, delivery of a weapon to the target.

43. The method of claim 42, further comprising transmitting, to the laser transmitter, confirmation the message was received.

44. The method of claim 42, wherein the message comprises fire control information.

45. The method of claim 42, wherein the receiving is performed asynchronously.

46. The method of claim 42, further comprising transmitting, to the laser transmitter, information regarding the status of the delivery.

47. A method, comprising:

providing a laser transmitter configured to transmit binary data at a bit transmission rate;

providing a first internal clock synchronized to an external timing device;

encoding, using a laser transmitter, the binary data corresponding to a message comprising information associated with a target in a laser beam at a modulation rate synchronized to the first internal clock;

transmitting, using the laser transmitter, the laser beam corresponding to a plurality of pulses at a pulse transmission rate;

detecting, using a sensor coupled to the imaging data receiver, the laser beam reflecting off a reflective surface;

decoding, using the imaging data receiver, the binary data over a plurality of integration periods or image frames, wherein the imaging data receiver is configured with a frame rate that is a non-zero integer multiple of the pulse transmission rate or of the bit transmission rate; and overlaying, onto a direct view image of the target, the position of the laser beam on the reflective surface.

48. The method of claim 47, further comprising overlaying, onto the direct view image of the target, information decoded from the laser beam.

49. A method, comprising:

providing a laser transmitter configured to transmit binary data at a bit transmission rate;

providing a first internal clock synchronized to an external timing device;

encoding, in a laser beam and using a laser transmitter, the binary data corresponding to a message comprising identify friend or foe (IFF) information at a modulation rate synchronized to the first internal clock;

transmitting, using the laser transmitter, the laser beam corresponding to a plurality of pulses at a pulse transmission rate, the laser beam transmitted through a diffuser that is visible to an imaging data receiver;

detecting, using a sensor, the laser beam reflecting off a reflective surface; and decoding, using the imaging data receiver, the binary data over a plurality of integration periods or image frames, wherein the imaging data receiver is configured with a frame rate that is a non-zero integer multiple of the pulse transmission rate or of the bit transmission rate.

50. A method comprising:

providing a laser transmitter configured to transmit binary data at a bit transmission rate;

providing a first internal clock synchronized to an external timing device;

encoding, using the laser transmitter, the binary data corresponding to a message comprising information associated with a target in a laser beam at a modulation rate synchronized to the first internal clock;

transmitting, using the laser transmitter, the laser beam projected onto a reflective surface, the laser beam corresponding to a plurality of pulses with a pulse transmission rate;

detecting using a sensor, the laser beam reflecting off the reflective surface;

decoding, using the imaging data receiver, the binary data over a plurality of integration periods or image frames, wherein the imaging data receiver is configured with a frame rate that is a non-zero integer multiple of the pulse transmission rate or of the bit transmission rate; and activating, using the imaging data receiver and responsive to the message, delivery of a weapon to the target.

51. A communication and spatial referencing system, comprising:

a transmitter configured to transmit binary data at a bit transmission rate, comprising:

a first clock operative at a first frequency; and a modulator for encoding the binary data in transmitted a radiation at a modulation rate synchronized to the first clock, wherein the transmitter is configured to transmit the radiation corresponding to a plurality of pulses at a pulse transmission rate; and an imaging data receiver configured to decode the binary data, comprising:

a second clock operative at a second frequency, and a sensor coupled to the second clock for detecting a portion of the radiation reflecting off a reflective target, wherein the imaging data receiver is configured to decode the binary data over a plurality of integration periods or image frames, and the imaging data receiver is configured with a frame rate that is a non-zero integer multiple of the pulse transmission rate or of the bit transmission rate.

* * * * *